US005098259A

United States Patent [19]

Ohtaki et al.

[11] Patent Number: 5,098,259

[45] Date of Patent: Mar. 24, 1992

[54] FLUID PUMP UNIT WITH FLOW CONTROL VALVE

[75] Inventors: Mizuo Ohtaki; Miyoko Hamao, both of Kanagawa, Japan

[73] Assignee: Atsugi Unista Corporation, Kanagawa, Japan

[21] Appl. No.: 572,894

[22] Filed: Aug. 24, 1990

[30] Foreign Application Priority Data

Aug. 29, 1989 [JP] Japan ..... 1-222394

[51] Int. Cl.[5] ..... F04B 49/00

[52] U.S. Cl. ..... 417/308; 417/310; 417/300

[58] Field of Search ..... 417/308, 310, 300

[56] References Cited

U.S. PATENT DOCUMENTS 4,597,718 7/1986 Nakano ..... 417/300

4,838,767 6/1989 Ohe ..... 417/308

*Primary Examiner*—Richard A. Bertsch

*Assistant Examiner*—Alfred Basichas

*Attorney, Agent, or Firm*—Bachman & Lapointe

[57] ABSTRACT

A fluid pump has a pressure chamber communicated with a discharge outlet via an orifice. A pressure difference responsive flow control valve is also provided for adjustment fluid flow rate through the discharge outlet. The flow control valve has a valve spool housed within a spool chamber. The spool chamber has one end directly opening to the pressure chamber.

7 Claims, 3 Drawing Sheets

FLUID PUMP UNIT WITH FLOW CONTROL VALVE

BACKGROUND OF THE INVENTION

1. Field of the Invention

The present invention relates generally to a fluid pump unit, such as for a power source of an automotive power steering system.

2. Description of the Background Art

Such type of fluid pump is provided with an orifice at a discharge outlet for supplying working fluid to a power steering unit through the orifice. A flow control valve is associated with the orifice so that excessive flow rate of working fluid can be returned to the inlet of the pump. The flow control valve includes a pressure difference responsive valve spool which is responsive to a pressure difference between the upstream and downstream of the orifice. In the recent technology, there is proposed a fluid pump which has a flow control valve associated with a pressure relief valve for relieving excess pressure at the outlet of the orifice. Such type of fluid pump has been disclosed in Japanese Utility Model First (unexamined) Publication No. 60-64071, for example.

This pump conventionally proposed holds drawbacks. For instance, in order to establish communication between the pressure chamber in the pump and the spool chamber of the flow control valve, a fluid flow path has to be provided. This requires extra space in a pump housing. Furthermore, in the conventional construction, the flow control valve is protruded from the pump housing to increase the bulk size of the pump unit. In contrast to this, as can be appreciated, the engine room in the modern motor vehicle is filled with a quite great number of accessory parts to motivate a strong requirement for more compact construction of the fluid pump for easy installation.

SUMMARY OF THE INVENTION

Therefore, it is an object of the present invention to provide a fluid pump which can achieve satisfactory reduction of the unit size.

In order to accomplish aforementioned and other objects, a fluid pump, according to the present invention, has a pressure chamber communicating with a discharge outlet via an orifice. A pressure difference responsive flow control valve is also provided for adjustment of fluid flow rate through the discharge outlet. The flow control valve has a valve spool housed within a spool chamber. The spool chamber has one end directly opening to the pressure chamber.

The aforementioned and other objects and advantages sought for the invention, can also be accomplished by separately arranging the flow control valve and a pressure relief valve for relieving an excess pressure to the inlet of the pump.

According to one aspect of the invention, a fluid pump unit comprises:

a pump casing housing therein a pump assembly and defining a pressure chamber with the outer periphery of the pump assembly, an inlet, an outlet which is communicated with the pressure chamber via an flow restriction orifice;

a flow control valve having a spool chamber defined in the pump casing for housing therein a valve spool, the spool chamber being in communication with a drain port for returning part of pressurized fluid to the inlet and a pressure induction port communicating with the outlet for introducing fluid pressure of the fluid in the outlet, and the spool chamber being in direct fluid communication with the pressure chamber; and a valve spool disposed within the spool chamber for selectively blocking and establishing fluid communication between the drain port and the spool chamber depending upon pressure difference between the pressure chamber and the outlet.

Preferably, the pump assembly defines a pump chamber communicating with the pressure chamber via a bent path, and the orifice opens at the corner of the bent path for exerting static pressure for working fluid flowing through the orifice.

According to another aspect of the invention, a fluid pump unit comprises:

a pump casing housing therein a pump assembly and defining a pressure chamber with the outer periphery of the pump assembly, an inlet, an outlet communicating with the pressure chamber via an flow restriction orifice;

a flow control valve having a spool chamber defined in the pump casing for housing therein a valve spool, the spool chamber being in communication with a drain port for returning part of pressurized fluid to the inlet and a pressure induction port communicating with the outlet for introducing fluid pressure of the fluid in the outlet;

a valve spool disposed within the spool chamber for selectively blocking and establishing fluid communication between the drain port and the spool chamber depending upon pressure difference between the pressure chamber and the outlet; and a pressure relief valve formed independently of the flow control valve for permitting independent disassembling and reinstallation of the flow control valve.

BRIEF DESCRIPTION OF THE INVENTION

The present invention will be understood more fully from the detailed description given herebelow and from the accompanying drawings of the preferred embodiment of the invention, which, however, should not be taken to limit the invention to the specific embodiment but are for explanation and understanding only.

DESCRIPTION OF THE PREFERRED EMBODIMENT

Figure 1:
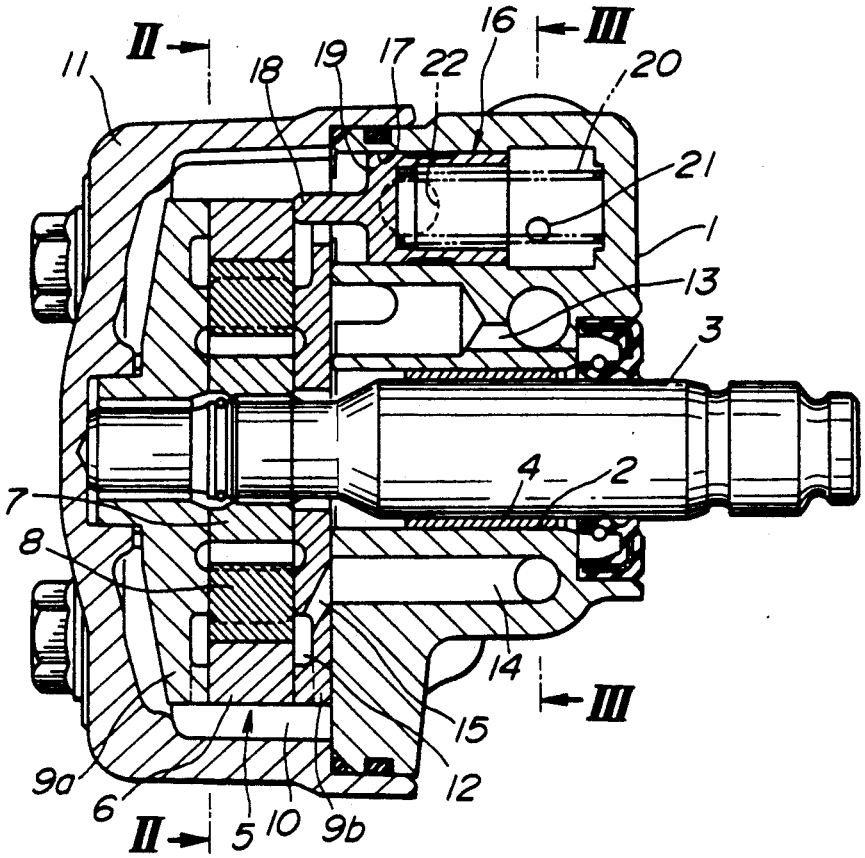
FIG. 1 is a section of the preferred embodiment of a fluid pump unit according to the present invention.
Figure 2:
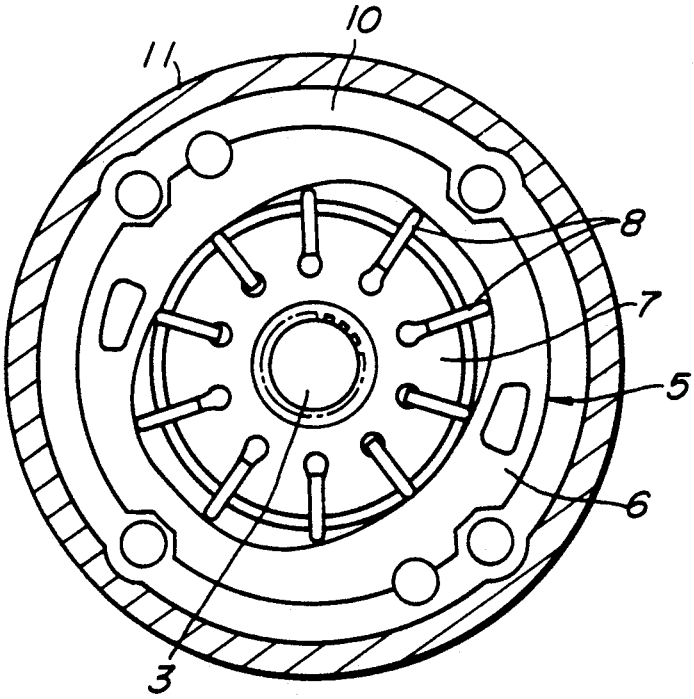
FIG. 2 is a section taken along line II—II of FIG. 1.

Referring now to the drawings, particularly to FIG. 1, the preferred embodiment of a fluid pump unit, according to the present invention, has a pump casing 1 which defines an axial bore 2. A pump shaft 3 is rotatably supported within the axial bore 2 by means of a bearing 4. A pump assembly 5 is mounted at the end of the pump shaft 3. The pump assembly 5 comprises a cam ring 6, a rotor 7, a plurality of vanes 8, and front and back plates **9*a* and 9*b*** for forming a rotary vane pump in a per se known construction. The pump assembly 5 is housed within a front cover 11. The cover 11 defines a pressure chamber 10 between the outer periphery of the pump assembly 5. The pressure chamber 10 communicates with a pump chamber 8a via a discharge path 12 defined in the front and back plates 9a and 9b, to introduce the pressurized fluid therethrough.

The pump casing 1 also defines an inlet port 13 to introduce working fluid therethrough from a fluid source, such as a fluid reservoir. The inlet port 13 communicates with the pump chamber 8a for supplying the working fluid introduced therethrough. A discharge port 14 is also defined in the pump casing 1. The discharge port 14 is connected to the pressure chamber 10 via the discharge path 12 and an orifice 15 defined through the back plate 9b. The discharge port 14 is communicates with an external load, such as an automotive power steering unit for supplying the pressurized working fluid.

A flow control valve 16 is provided in parallel relationship with the pump shaft 3. The flow control valve 16 comprises a spool chamber 17 defined in the pump casing 1. A valve spool 19 is movably disposed within the spool chamber 17. The valve spool 19 is formed with a stopper projection 18 which is extended axially to restrict axial movement of the valve spool. On the other hand, the valve spool 19 is normally biased by means of a bias spring 20. As seen from FIG. 1, the spool chamber 17 is formed in direct communication with the pressure chamber 10 at one end. A pressure relief port 22 and a pressure induction port 21 also open to the spool chamber 17 at axially offset positions relative to each other. The pressure relief port 22 is connected to fluid reservoir or inlet port for returning the working fluid therethrough. On the other hand, the pressure induction port 21 is connected to the discharge port 14 for introducing the fluid pressure at the discharge port.

As can be seen, the pressure difference between the pressure chamber 10 and the discharge port 14 is within a predetermined pressure difference range defined by the set force of the bias spring 20, the pressure relief port 22 is blocked by the valve spool 19. Therefore, the fluid in the pressure chamber is fully supplied to the discharge port 14 via the orifice 15 to be supplied to the load. On the other hand, when the pressure in the pressure chamber 10 becomes excessively high to over come the spring force of the bias spring 20 and the fluid pressure introduced through the pressure induction port 21, then, the valve spool 19 is shifted to the pressure relief position for relieving the excess pressure to the inlet port 13.

Figure 3:
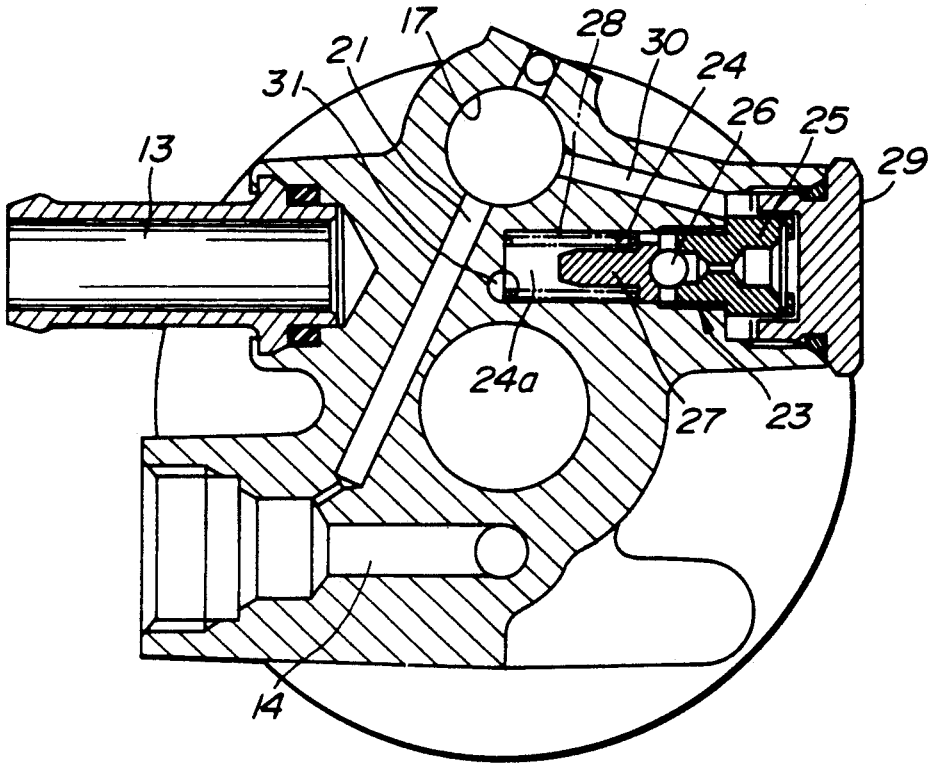
FIG. 3 is a section taken along line III—III of FIG. 1.
Figure 4:
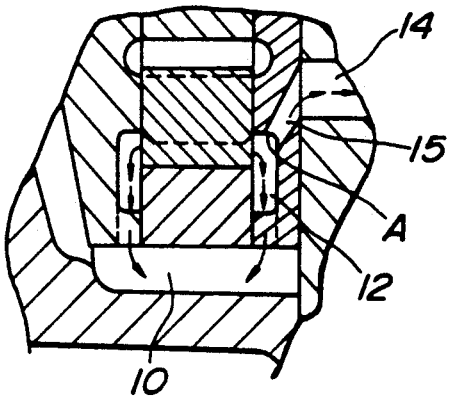
FIG. 4 is an enlarged section of the major part of the preferred embodiment of the fluid pump unit of FIG. 1.

The shown embodiment of the fluid pump unit is also provided with a pressure relief valve 23 independently of the flow control valve, as shown in FIG. 3. The pressure relief valve 23 comprises a valve bore 24 defined in the valve casing 1. A valve seat 25, a valve body 26, a retainer 27 and a bias spring 28 are housed within the valve bore 24. The outer end opening of the valve bore 24 is closed by an end plug 29. A high pressure port 30 opens to the valve bore for establishing fluid communication between the pressure chamber 10 via the spool chamber 17 of the flow control valve 16. Also, a pressure relief port 31 opens at the bottom portion 24a of the valve bore 24. The pressure relief port 31 is thus establish fluid communication between the valve bore 24 with the inlet port 13.

With the shown construction, since the pressure relief valve 23 is formed separately from the flow control valve 16, disassembling of the pressure control valve can be easily done by removing the end plug 29. Therefore, adjustment of the relief point of the pressure relief valve 23 can be easily adjusted. Furthermore, reinstallation of the pressure relief valve 23 can also be done easily.

Figure 5:
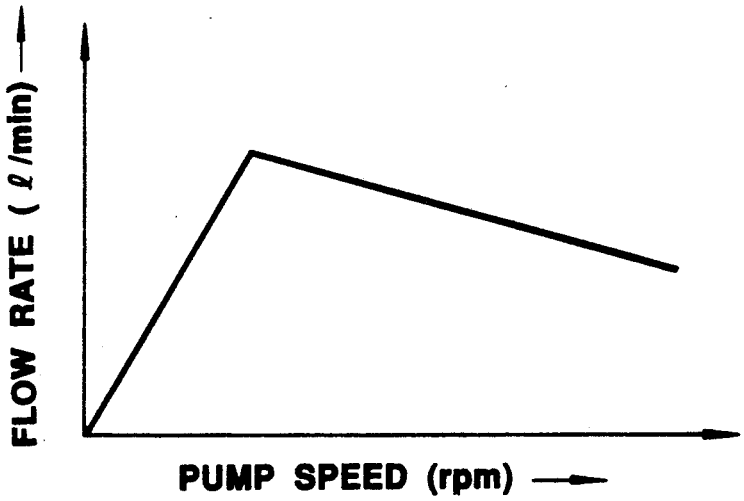
FIG. 5 is a fluid flow characteristics to be achieved by the preferred embodiment of the fluid pump.

With the shown construction, while the pump speed is relatively low, i.e. lower than a predetermined critical pressure, the fluid pressure in the pressure chamber 10 may not overcome the combined force of the bias spring 20 and the fluid pressure introduced through the pressure induction port 21 from the discharge port. Therefore, the pressure relief port 22 is maintained in blocked position by the valve spool 19. Therefore, at this position, the discharge pressure at the discharge port 14 increases in linearly proportional to increasing of the pump speed, as shown in FIG. 5.

When the pump speed is further increased, the pressure in the pressure chamber 10 becomes high enough to overcome the combined force of the bias spring 20 and the fluid pressure introduced through the pressure induction port 21. Then, the valve spool 19 is shifted to open the pressure relief port 22. Therefore, the part of the pressurized fluid in the pressure chamber 10 is drained to the inlet port 13 via the pressure relief port 22.

In the shown embodiment, the orifice 15 opens at a corner A of the discharge path 12 at which flow direction of the pressurized fluid is deflected. Therefore, the fluid flowing through the orifice 15 may be influenced by a static pressure. Namely, at the corner A, dynamic pressure is relatively high and static pressure is relatively low. This tendency is increased according to increasing of the pump speed. Therefore, the pressure of the fluid discharged through the orifice 15 can be decreased by the influence of the static pressure at the corner A. Therefore, fluid pressure to be discharged through the discharge port 14 becomes slightly descending due to effect of the pressure relief valve 23, as shown in FIG. 5.

While the present invention has been discussed in detail in terms of the preferred embodiment with reference to the accompanying drawings, the invention can be embodied in various fashion and thus should not be limited to the shown construction. Therefore, the invention should be understood to include all possible embodiments and modifications which can be implemented without departing from the principle of the invention set out in the appended claims.

What is claimed is:

1. A fluid pump unit comprising:

a pump casing housing therein a pump assembly and defining a pressure chamber with the outer periphery of the pump assembly, an inlet, an outlet communicating with said pressure chamber via a flow restriction orifice;

a flow control valve having a spool chamber defined in said pump casing for housing therein a valve spool, said spool chamber being in communication with a pressure relief port which in turn communicates with said inlet for returning part of pressurized fluid to said inlet and a pressure induction port communicating with said outlet for introducing fluid pressure of the fluid in said outlet, and said spool chamber being in direct fluid communication with said pressure chamber; and a valve spool disposed within said spool chamber for selectively blocking and establishing fluid communication between said pressure relief port and said spool chamber depending upon pressure difference between said pressure chamber and said outlet.

2. A fluid pump unit as set forth in claim 1, which further comprises a pressure relief valve formed independently of said flow control valve for permitting independent disassembling and reinstallation of said flow control valve.

3. A fluid pump unit as set forth in claim 2, wherein said pressure relief valve comprises a valve bore defined in said pump casing and connected to said pressure chamber via said spool chamber of said flow control valve, said pressure relief valve selectively establishing and blocking fluid communication between said pressure chamber and a pressure relief port which is communicated with said inlet.

4. A fluid pump unit comprising:

a pump casing housing therein a pump assembly and defining a pressure chamber with the outer periphery of the pump assembly, an inlet, an outlet communicating with said pressure chamber via a flow restriction orifice;

a flow control valve having a spool chamber defined in said pump casing for housing therein a valve spool, said spool chamber being in communication with a pressure relief port which in turn communicates with said inlet for returning part of pressurized fluid to said inlet and a pressure induction port communicating with said outlet for introducing fluid pressure of the fluid in said outlet, and said spool chamber being in direct fluid communication with said pressure chamber;

a valve spool disposed within said spool chamber for selectively blocking and establishing fluid communication between said pressure relief port and said spool chamber depending upon pressure difference between said pressure chamber and said outlet; and a pressure relief valve formed independently of said flow control valve for permitting independent disassembling and reinstallation of said flow control valve.

5. A fluid pump unit as set forth in claim 4, wherein said pressure relief valve comprises a valve bore defined in said pump casing and connected to said pressure chamber via said spool chamber of said flow control valve, said pressure relief valve selectively establishing and blocking fluid communication between said pressure chamber and a pressure relief port which is communicated with said inlet.

6. A fluid pump unit comprising:

a pump casing housing therein a pump assembly and defining a pressure chamber with the outer periphery of the pump assembly, an inlet, an outlet communicating with said pressure chamber via a flow restriction orifice;

a flow control valve having a spool chamber defined in said pump casing for housing therein a valve spool, said spool chamber being in communication with a pressure relief port which in turn communicates with said inlet for returning part of pressurized fluid to said inlet and a pressure induction port communicating with said outlet for introducing fluid pressure of the fluid in said outlet, and said spool chamber being in direct fluid communication with said pressure chamber;

a valve spool disposed within said spool chamber for selectively blocking and establishing fluid communication between said pressure relief port and said spool chamber depending upon pressure difference between said pressure chamber and said outlet; and wherein said pump assembly defines a pump chamber communicating with said pressure chamber via a bent path, and said orifice opens at the corner of said bent path for exerting static pressure for working fluid flowing through said orifice.

7. A fluid pump unit comprising:

a pump casing housing therein a pump assembly and defining a pressure chamber with the outer periphery of the pump assembly, an inlet, an outlet communicating with said pressure chamber via a flow restriction orifice;

a flow control valve having a spool chamber defined in said pump casing for housing therein a valve spool, said spool chamber being in communication with a pressure relief port which in turn communicates with said inlet for returning part of pressurized fluid to said inlet and a pressure induction port communicating with said outlet for introducing fluid pressure of the fluid in said outlet, and said spool chamber being in direct fluid communication with said pressure chamber;

a valve spool disposed within said spool chamber for selectively blocking and establishing fluid communication between said pressure relief port and said spool chamber depending upon pressure difference between said pressure chamber and said outlet;

wherein said pressure relief valve comprises a valve bore defined in said pump casing and connected to said pressure chamber via said spool chamber of said flow control valve, said pressure relief valve selectively establishing and blocking fluid communication between said pressure chamber and a pressure relief port communicating with said inlet; and wherein said pump assembly defines a pump chamber communicating with said pressure chamber via a bent path, and said orifice opens at the corner of said bent path for exerting static pressure for working fluid flowing through said orifice.

* * * * *